United States Patent [19]

Kozacka

[11] 3,949,342

[45] Apr. 6, 1976

[54] ELECTRIC FUSE FOR ELEVATED CIRCUIT VOLTAGES

[75] Inventor: Frederick J. Kozacka, South Hampton, N.H.

[73] Assignee: The Chase-Shawmut Company, Newburyport, Mass.

[22] Filed: Apr. 7, 1975

[21] Appl. No.: 565,368

[52] U.S. Cl. ..... 337/161; 337/274; 337/279

[51] Int. Cl.[2] ..... H01H 85/04

[58] Field of Search ..... 337/158, 159, 160, 161, 337/273, 274, 279

[56] References Cited

UNITED STATES PATENTS

| | | | |
|---|---|---|---|
| 2,382,271 | 8/1945 | Suits et al. | 337/161 X |
| 3,012,121 | 12/1961 | Hicks | 337/160 |
| 3,810,062 | 5/1974 | Kozacka | 337/161 |

*Primary Examiner*—George Harris
*Attorney, Agent, or Firm*—Erwin Salzer

[57] ABSTRACT

A fuse for elevated circuit voltages is provided with an arrangement or array of gas-evolving beads intended to improve the performance of the fuse under major fault current conditions. The fusible element is wound around a space in the shape of a four-sided prism, each full turn including four quarter sections. The fusible element supports a plurality of beads of a gas-evolving material that are positioned on all four sides of said space and substantially equally distributed among the four sides thereof. Said beads are mounted periodically on said quarter sections of said fusible element in such a way that bead-bearing quarter sections of said fusible element alternate with equal numbers of non-bead-bearing quarter sections thereof.

7 Claims, 7 Drawing Figures

ELECTRIC FUSE FOR ELEVATED CIRCUIT VOLTAGES

BACKGROUND OF THE INVENTION

This invention relates to electric current-limiting fuses for elevated circuit voltages, in particular for circuit voltages from about 5 kv to voltages in excess of 30 kv.

This invention is predicated on the application on the method of assembling high-voltage fuses disclosed and claimed in the U.S. Pat. No. 3,848,214 to Erwin Salzer, 11/12/74 for METHOD OF ASSEMBLING ELECTRIC HIGH-VOLTAGE FUSES AND SUBASSEMBLY THEREFOR, assigned to the same assignee as the present invention.

This invention is also an outgrowth of the structure disclosed and claimed in my U.S. Pat. No. 3,810,062, 05/07/74 for HIGH VOLTAGE FUSE HAVING FULL RANGE CLEARING ABILITY, assigned to the same assignee as the present invention.

Before considering the relation of the present invention to the respective subject-matter of the two above patents, some brief general historical remarks relating to the development of high-voltage circuit interrupting devices seem to be in order.

One of the earliest high-voltage circuit interrupting devices was the plain oil circuit breaker. In such circuit breakers an electric arc is drawn by separation of a pair of contacts under oil. The ensuring arc breaks down the oil, thus forming a gas bubble or arc bubble surrounding the arc. The high thermal conductivity of the hydrogen in that gas bubble results in relatively rapid cooling of the arc and consequent arc extinction. Thus in the plain oil circuit breaker arc extinction as such is essentially a static rather than a dynamic process involving rapid flows of de-ionizing media. As time went on the requirements in regard to interruption of high-voltage circuits became more onerous and then the above essentially static mechanism of arc-extinction was not adequate any longer. Because of this inadequacy many novel families of circuit breakers evolved, all having the common feature that arc-extinction is effected by dynamic processes involving the rapid flow of de-ionizing media. The explosion pot circuit breaker, the oil impulse circuit breaker, the air blast circuit breaker and modern $SF_6$ circuit breakers are predicated upon dynamic processes, involving the rapid flow of de-ionizing media.

The current-limiting fuse as it has been known to-date is essentially a static circuit interrupting device, predicated on the high heat of fusion of quartz sand rather than on establishing closely controlled jets of arc-extinguishing gases. It is true that current-limited fuses were sometimes provided with structures that evolve gases under the heat of the electric arcs, but such structures were provided mainly to make it possible for current-limiting fuses to interrupt extremely small overload currents, e.g. overload currents in the range of the 1 hour fusing current, or slightly smaller, or slightly larger, overload currents.

In conventional designs of high-voltage fuses the fusible element is wound helically around a mandrel, or supporting core, of a material that evolves arc-quenching gases under the action of electric arcs. This arrangement results generally in evolution of too much arc-quenching gas when such fuses are called upon to interrupt major fault currents. Generation of high pressures caused by generation of very large quantities of arc-quenching gases is conducive to bursting of the casings of the fuse, or to excessive requirements in regard to the bursting strength thereof. These drawbacks can be avoided by using composite mandrels for supporting the fusible elements, portions of which mandrels being made of gas-evolving materials, while other portions thereof are made of non-gas-evolving materials. The cost-effectiveness of this type of fuses is not very satisfactory. My above referred-to U.S. Pat. No. 3,810,062 as well as my U.S. Pat. No. 3,864,655 teach the use of beads of a gas-evolving material, combined with overlays of low fusing point materials on the fusible element (so-called M-effect causing materials) as means for effectively interrupting overload currents of very small magnitude, thus arriving at a novel type of high-voltage fuses having full range clearing ability. I have discovered that high-voltage fuses as shown in my U.S. Pat. No. 3,810,062 not only enhance their small overload performance, but have also the tendency to enhance their major fault current interrupting performance, provided the various paramters which go into their design are correctly selected to achieve this end.

Non-gas-evolving mandrels for supporting fusible elements or non-gas-evolving fusible element supporting cores are used in high-voltage fuses wherein the interrupting capacity is limited at the lower end of the current interrupting range. In such fuses the current interrupting process is essentially static in the sense that their arc-extinction is essentially predicated on the heat absorbing action of granular $SiO_2$ rather than the action of closely controlled fluid blasts.

Considering now fuses having mandrels for supporting their fusible elements that are made entirely of a gas-evolving material, as mentioned above, in such fuses the amount of gas evolved under major fault current conditions tends to be excessive on account of the fact that gas-evolution increases as the current intensity increases, and also on account of the fact that the number of points at which gas is evolved from such mandrels or cores is equal to the number of points at which the mandrel or core is engaged by the fusible element, or elements. In such fuses the effectiveness under major fault current conditions of the large number of gas-evolving points in regard to generation of arc voltage is relatively small, because the arc is not restricted to, or fixedly held at, the points of gas generation, but is induced to move away from these points into the arc-quenching filler where the arc is quenched by the filler's heat absorbing action rather than by dynamic fluid jet action.

Since the number and the size of gas-evolving beads in a high-voltage fuse as disclosed in U.S. Pat. No. 3,810,062 can be selected as deemed necessary, or desirable, the danger of excessive gas evolution at major fault currents can be effectively avoided in such a fuse. If a break or an arc is formed in a bead of a high-voltage fuse as disclosed in U.S. Pat. No. 3,810,062, the arc cannot be displaced out of the bore in the bead in which it is trapped, but is held captive in the bore, and while held captive inside the latter, subject to the action of highly effective blasts of arc extinguishing gas. These blasts of gas originate inside the bore of each gas-evolving bead and extend axially outwardly in opposite directions. If the cross-section of the bores in the beads is sufficiently small to preclude, or to minimize, entry of particles of pulverulent arc-extinguishing filler or quartz sand into the bores, no fulgurites can form inside of the bores. Hence each gas-evolving bead and its bore forms an interruption of the substantially helical fulgurite which replaces the fusible element following blowing of the fuse. These interruptions preclude the flow of current through the fulgurite following extinction of the arc discharge.

The fuse disclosed in U.S. Pat. No. 3,810,062 has no mandrel or supporting core for the fusible element, the supporting function of the fusible element being solely achieved by the pulverulent arc-quenching filler as such and the gas-evolving action being achieved by the gas-evolving beads.

The above is an outgrowth of the structure disclosed in U.S. Pat. No. 3,810,062 and of its actual performance.

The present invention is based on the above analysis, and is particularly concerned with an optimal positioning of gas-evolving beads for the purpose of optimizing the performance of the fuse under major fault current conditions rather than under overload conditions.

SUMMARY OF THE INVENTION

Fuses embodying this invention include a casing of electric insulating material, a pair of terminal elements arranged at the ends of said casing and closing said casing, and a pulverulent arc-quenching filler inside said casing. A fusible element embedded in said filler conductively interconnects said pair of terminal elements. Said fusible element is wound in quarter turn sections of substantially constant pitch around the lateral sides of a space in the form of a four sided prism. Fuses embodying this invention further include a plurality of beads of a gas-evolving material supported by said fusible element, positioned on all four sides of said space and substantially equally distributed among said four sides thereof. Said beads are mounted periodically on said quarter turn sections of said fusible element in such a way that bead-bearing quarter turn sections of said fusible element alternate with equal numbers of non-bead bearing quarter turn sections thereof.

DESCRIPTION OF PREFERRED EMBODIMENT

Figure 1:
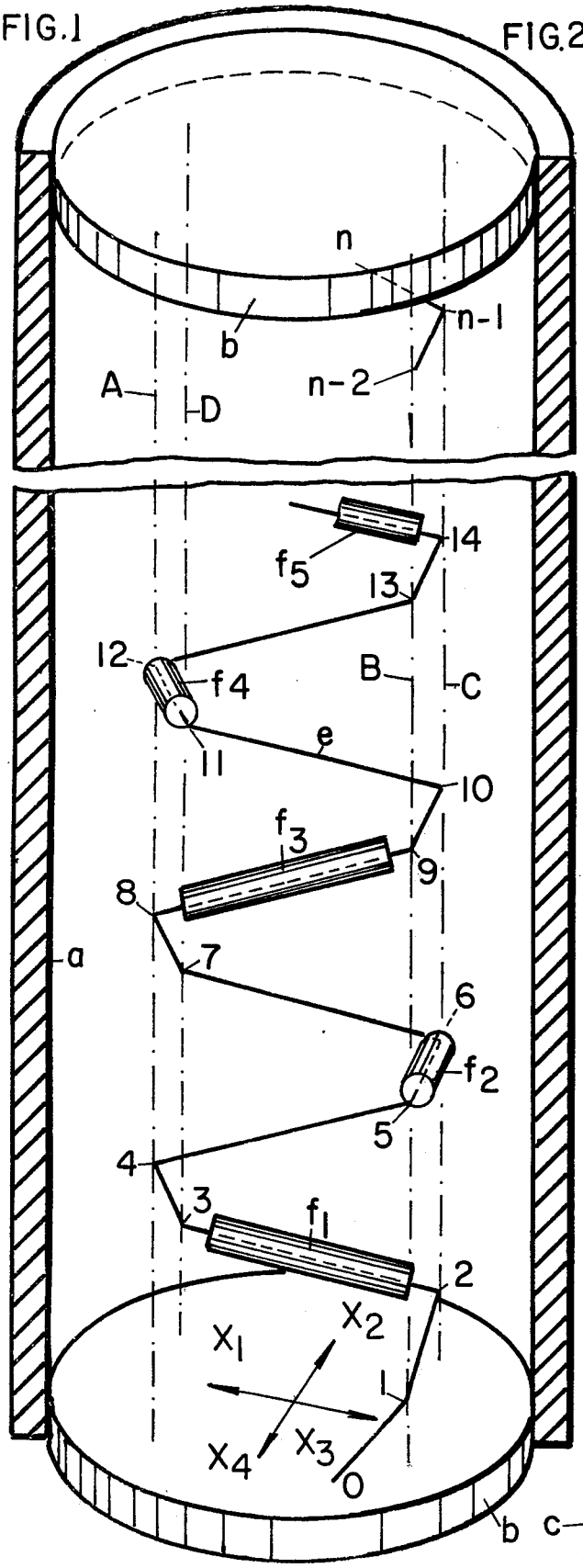
FIG. 1 is a diagrammatic isometric representation of a fuse embodying this invention, the pulverulent arc-quenching filler forming part of the fuse having been deleted in FIG. 1, and a portion of the fuse structure having been broken away in FIG. 1 to show the remaining portion of the structure on a relatively large scale.

The fuse shown in the drawings is a result of the process of assembly disclosed in detail in the above referred-to U.S. Pat. No. 3,848,214. This process includes the steps of a. providing a pair of terminal plugs with four axially extending bores circular in cross-section arranged to establish a pattern in the shape of a rectangle or the shape of a square;

b. threading four rods through said four bores in one of said pair of terminal plugs, establishing firm engagement of the ends of said four rods remote from said one of said pair of terminal plugs inside said four bores in the other of said four bores in the other of said pair of terminal plugs and maintaining a fixed spacing between said pair of terminal plugs by means of said four rods;

c. winding a fusible element substantially helically around the portion of said four rods situated between the axially inner end surfaces of said pair of terminal plugs and conductively connecting each end of said fusible element to one of said pair of terminal plugs;

d. inserting the squirrel-cage-like structure formed by said pair of terminal plugs and said four rods with said fusible element thereon into a tubular casing and affixing said pair of terminal plugs to said casing; and thereafter e. filling said casing with a pulverulent arc-quenching filler through a filling aperture in either one of said pair of terminal plugs and removing said plurality of rods from said fusible element and from the space inside said casing through said four bores in said one of said pair of terminal plugs.

In a high-voltage fuse manufactured as indicated above the fusible element is arranged within the lateral sides of a space in the shape of a four sided prism. The fusible element has bends coextensive with the lateral edges of said space in the shape of said prism and said bends are not supporting by any supporting means other than the pulverulent arc-quenching filler inside of the casing. A plurality of beads of a gas-evolving material may be supported by the fusible element.

Figure 2:
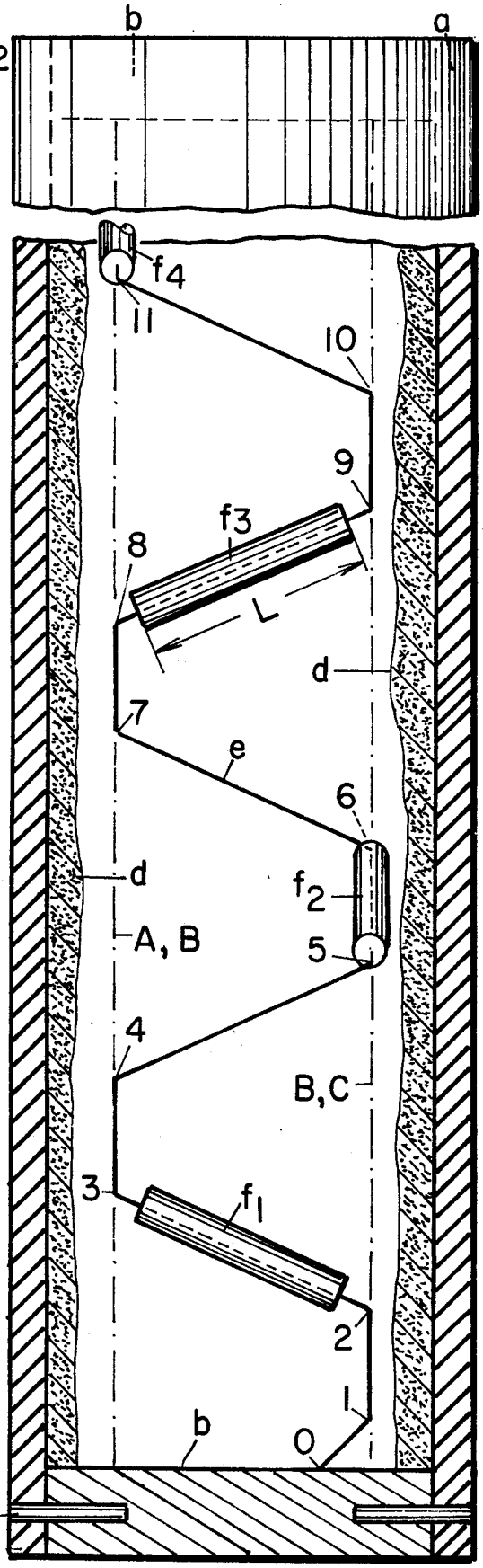
FIG. 2 is in part a longitudinal section and in part an elevation of the structure of FIG. 1, a portion of the structure of FIG. 2 being broken away.

FIGS. 1 and 2 of the accompanying drawings shows an electric fuse that includes a tubular casing *a* of electric insulating material. As shown in FIGS. 1 and 2 one half of a casing *a* is sectioned away. Casing *a* is closed on the ends thereof by a pair of terminal elements *b*. Terminal elements *b* are in the form of discs or plugs, and are affixed to casing *a* by steel pins *c* projecting in radial direction through casing *a* into terminal plugs *b*. (See bottom of FIG. 2) A pulverulent arc-quenching filler *d*, preferably quartz sand, is arranged inside of casing *a*. That filler has not been shown in FIG. 1 in order to better expose to view the parts inside of casing *a*. In FIG. 2 the presence of filler *d* has been indicated in the regions adjacent to casing *a*, but not in the center region of casing *a* in order to better expose to view the parts inside of the casing. Fusible element *e* conductively interconnects terminal elements *b* and is embedded in pulverulent arc-quenching filler *d*. Fusible element *e* may either be in the form of a wire or a narrow ribbon (See FIG. 5), preferably of silver. As a general rule the narrow ribbon form will be adopted, but for reasons of simplicity the fusible element *e* has been shown in FIGS. 1 and 2 by a single solid line. Fusible element *e* is wound in quarter turn sections of substantially constant pitch around the lateral sides of a space in the form of a four sided prism. The four straight edges of this space have been indicated in FIGS. 1 and 2 by dash-and-dot lines A,B,C,D. In FIG. 1 the arrangement of the lines A,B,C,D which indicate the sides of a four sided prism is counter-clockwise. The four planar imaginary lateral surfaces of the aforementioned space in the shape of a four sided prism are defined by four pairs of lines, namely A and B; B and C; C and D; and D and A. The fusible element *e* is arranged within the lateral sides of the aforementioned space in the shape of a four sided prism. Reference numeral 0 has been applied to indicate the point at which fusible element *e* is conductively connected to lower terminal plug *b*. Fusible element *e* then rises to point 1 on edge B, to point 2 on edge C, to point 3 on edge D, to point 4 on edge A, to point 5 on edge B, to point 6 on edge C, etc. Reference character *n* has been applied to indicate the point where fusible element *e* is conductively connected to upper terminal plug *b*. From there fusible element *e* extends downwardly to point *n*-1 on line C, and from there to point *n*-2 on line B. The prismatic space defined by lines A,B,C,D is preferably square in cross-section or, to be more specific, in a cross-section drawn parallel to the end surfaces of terminal plugs *b*. The fusible element *e* is wound in sections of substantially constant pitch around edges A, B,C,D. However, the pitch of sections 0-1 and *n* to *n*-1 is steeper than the pitch of all other sections such as sections 1 to 2; 2 to 3, 3 to 4, . . . . . *n*-2 to *n*-1. Reference character *f* has been applied to indicate beads of a gas-evolving material through which fusible element *e* is threaded or, in other words, which are mounted on fusible element *e*. Beads *f* are positioned on all four sides of the prismatic space defind by lines A,B,C,D and substantially equally distributed among said four sides. Considering any particular fuse, there may be N beads in the plane defined by lines A and B, N beads in the plane defined by lines B and C, N beads in the plane defined by lines C and D, and N beads in the plane defined by lines D and A. The beads *f* are mounted periodically on quarter turn sections of fusible element *e* in such a way that bead-bearing sections alternate with equal numbers of non-bead-bearing sections. This arrangement of beads optimizes the arc-quenching effectiveness of the pulverulent filler *d* and distributes the beads, or gaps, formed in the fulgurite resulting from blowing of the fuse in such a way as to reduce virtually, or actually, to zero the follow current that flows after arc-extinction through the fulgurite. It will be noted that the two sections 0 to 1 and 1 to 2 of the fusible element *e* do not support a gas-evolving bead *f*. The following quarter turn section 2 to 3 of the fusible element *e* supports a gas-evolving bead $f_1$. The following quarter turn sections 3 to 4 and 4 to 5 of fusible element *e* are non-bead-bearing sections and are followed by the bead-bearing quarter turn section 5-6. Speaking more generally, the periodicity underlying the embodiment shown in FIGS. 1 and 2 consists in pairs of non-bead-bearing sections following one bead-bearing quarter turn section. The number of non-bead-bearing quarter turn sections which are present between bead-bearing quarter turn sections may be, and generally is, considerably larger than two, e.g. four as shown in FIG. 7.

A given situation may call for a given number of gas-evolving beads having a predetermined length. It is within the discretion of the designer to specify the number of beads and their length to achieve a given result. Hence it is generally possible to select the bead length and it is desirable to select the length L of the gas-evolving beads *f* in such a way that their length is substantially equal to the width of the lateral sides of the aforementioned space in the form of a four-sided prism. In other words, the length L of beads *f* should be substantially equal to the distance between lines A,B; B,C; C,D; D,A or, in other words, slightly less than the length of quarter turn sections such as 1 to 2; 2 to 3; 3 to 4; etc., or slightly less than the distance between contiguous bends of the fusible element *e*. The reason underlying this choice of bead-length L resides in the fact that the beads *f* are self-positioning while the fuse is assembled in accordance with the teachings of the aforementioned U.S. Pat. No. 3,848,214.

Figure 7:
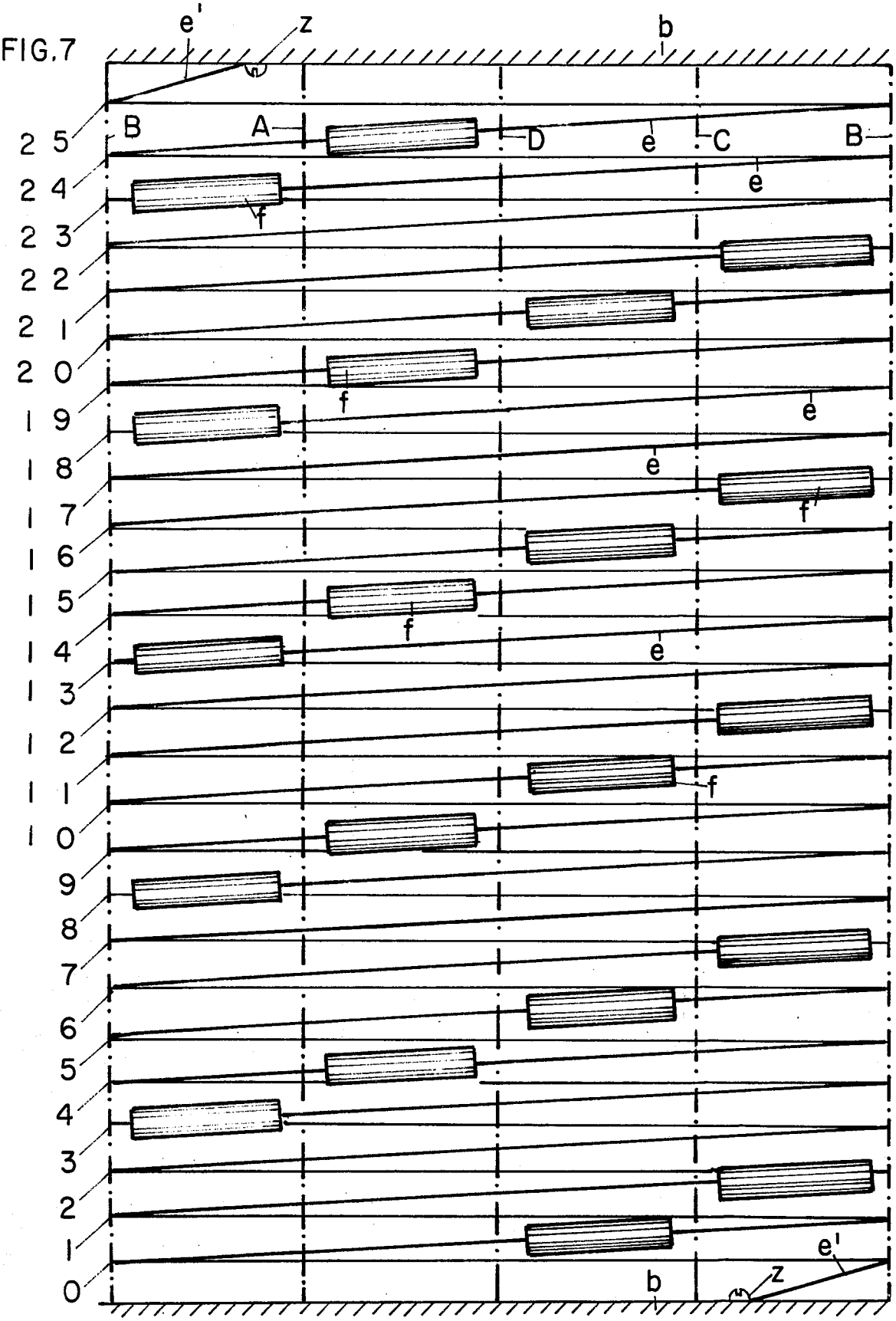
FIG. 7 is a diagrammatic representation showing the arrangement of a plurality of gas-evolving beads on a fusible element in accordance with the present invention.

It will be apparent from the above that beads *f* have substantially equal spacings from each other in a direction longitudinally of casing *a*, as also clearly shown in FIG. 7. Axially contiguous beads *f* are arranged in such a way that they are angularly displaced in the same direction. This will be more apparent from what follows: The direction of bead $f_1$ on section 2 to 3 may be represented by vector $X_1$, the direction of the axially contiguous bead $f_2$ on section 5 to 6 may be represented by vector $X_2$, the direction of the bead $f_3$ on the next higher level or on section 8 to 9 may be represented by vector $X_3$, and the direction of the bead $f_4$ on the next higher level or on section 11 to 12 may be represented by vector $X_4$. To arrive at this vector representation shown in FIG. 1 the pointed ends of each vector stands for the higher level of each particular bead $f_1, f_2, f_3, f_4$. The full import of the statement that axially contiguous beads are angularly displaced in the same direction will be fully apparent from the counter-clockwise angular relation of vectors $X_1,X_2,X_3$ and $X_4$ in FIG. 1.

Another mode of defining the structure of FIGS. 1 and 2 is to state that the beads $f_1,f_2,f_3$ . . . supported by quarter turns of fusible element *e* are spaced from each other by a fixed number of non-bead-supporting quarter turn sections. Said fixed number is selected in such a way that the constituent beads of the plurality of beads $f_1 f_2 \ldots f_n$ are substantially equally apportioned to each of the four lateral planes of the aforementioned space in the form of a four-sided prism having the edges A,B,C,D. This has best been shown in FIG. 7 to be considered below.

Figure 3:
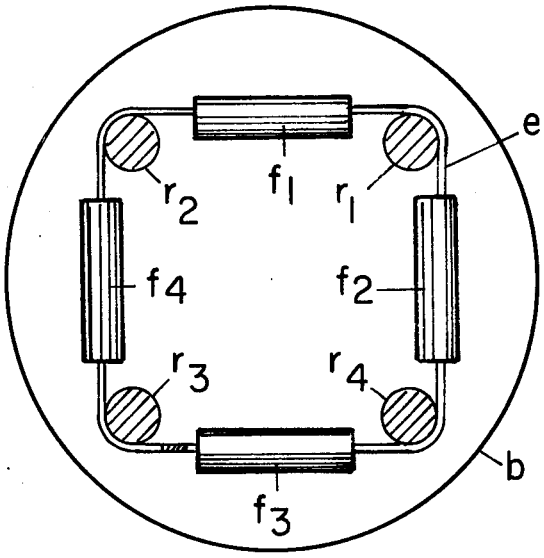
FIG. 3 is a cross-section of the structure of FIG. 1 while being in the process of assembly.
Figure 4:
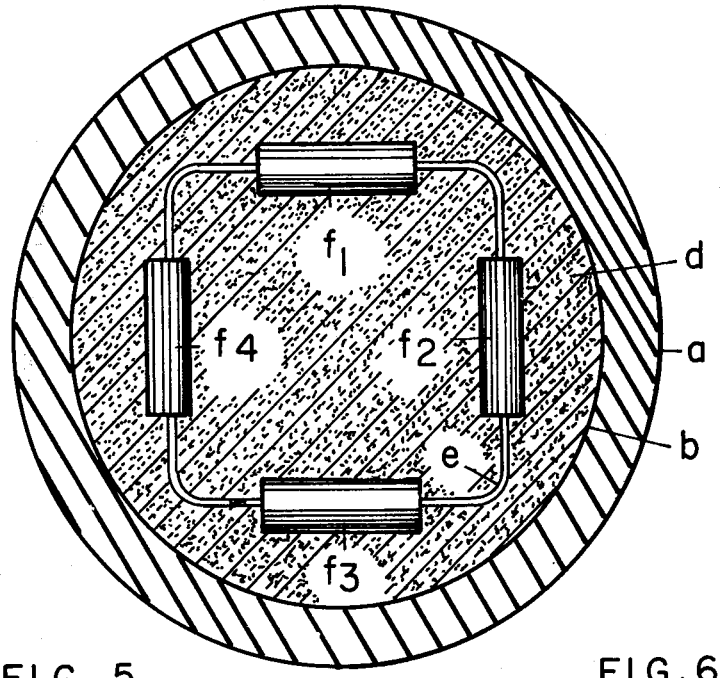
FIG. 4 is a cross-section of the structure of FIG. 1 upon completion of its assembly.

In FIG. 3 reference characters $r_1,r_2,r_3,r_4$ have been applied to indicate four metal rods used to form jointly with terminal plugs *b* a squirrel-cage-like structure around which fusible element *e* is initially wound. Quarter turn sections of fusible element e support the beads $f_1,f_2,f_3,f_4$ . . . of gas-evolving material. The length of the latter is but slightly less than the spacing between rods $r_1,r_2,r_3,r_4$. As a result, the position of the beads is, in substance, determined by the spacing between rods $r_1$, $r_2,r_3,r_4$, i.e. beads $f_1,f_2,f_3,f_4$ have little leeway to move from the position shown along fusible element *e*. It is further desirable to maximize the length of beads $f_1,f_2$ . . . because this optimizes the action of the filler *d* in supporting fusible element *e* by the intermediary of beads $f_1,f_2$ . . . following removal of the rods $r_1$, $r_2,r_3,r_4$ from the assembly after insertion of plugs *b*, fusible element *e* and beads $f_1,f_2$ . . . into a casing *a* as shown in FIG. 4.

Figure 5:
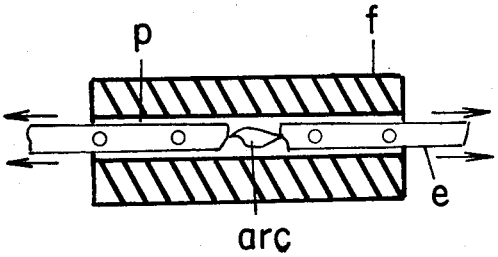
FIG. 5 illustrates the process of arc-initiation inside of a gas-evolving arc-quenching bead.
Figure 6:
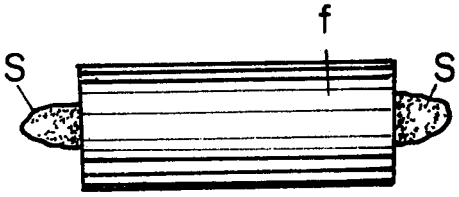
FIG. 6 illustrates a fulgurite resulting from that process.

As mentioned above, fusible element *e* will normally be a narrow ribbon of silver in which points of relatively small cross-sectional area alternate with points of relatively large cross-sectional area to limit the voltage surge $-L\ (di/dt)$ generated incident to blowing of the fuse. FIG. 5 shows a gas-evolving bead f mounted on a fusible element *e*. An arc has been kindled inside of gas-evolving bead $f$ and jets of plasma, i.e. ionized gas, indicated by arrows, issue at both ends of the bore $p$ extending through bead $f$. The fusible element $e$ normally plugs bore $p$ to such an extent that either no particles, or but only a few particles, of the pulverulent arc-quenching filler $d$ by which the beads $f_1 f_2 \ldots$ in the structures of FIGS. 1,2 and 4 are surrounded, can enter into bore or passageway $p$. The few particles that entered into bore or passageway $p$ are likely to be ejected by the blasts of plasma that come out at both ends of passageway $p$. FIG. 6 shows the two fulgurites that tend to form adjacent the end surfaces of gas-evolving beads $f$ as the result of injection of plasma into the surrounding arc-quenching filler $d$. The fulgurites S are oriented in the direction of passageways $p$. They do not tend to form conductive by-passes of gas-evolving beads $f_1 f_2 \ldots$. Consequently the fulgurite that takes the place of the fusible element $e$ in FIGS. 1 and 2 following blowing of the fuse is effectively chopped into a large number of sections that are effectively insulated from each other by beads $f_1 f_2 \ldots$.

Referring now to FIG. 7, the surface in the shape of a four sides prism defined by edges A,B,C,D has been cut open along edge B and developed into the plane of the drawing paper. The winding between terminals $b$ of fusible element $e$ includes 25 full turns and hence $25 \times 4 = 100$ quarter turn sections. Five gas-evolving beads $f$ are arranged on each lateral surface of the four sided prism defined by edges A,B,C,D. The lower terminal element $b$ is provided with a clamping screw $z$ clamping one end of fusible element $e$ to lower terminal element $b$. The fusible element rises steeply from clamping screw $z$ to the 0 level. The pitch of fusible element $e$ is constant from level 0 to level 25 where the 25th turn of fusible element $e$ ends. Fusible element $e$ rises from level 25 to the upper clamping screw $z$ at a steeper pitch than the portion of fusible element $e$ situated between levels 0 and 25. Reference character $e'$ has been applied to indicate the steep sections of fusible element $e$ extending between levels 0 and 25, respectively, to the lower and the upper clamping screw $z$, respectively. Beads $f$ of gas-evolving material are supported by quarter turn sections of fusible element $e$ that are spaced from each other by a fixed number, (namely 4) non-bead-bearing quarter turn sections. The total of 20 gas-evolving beads is equally distributed among the four sides of the four sided prism defined by its edges A,B,C,D. The spacing of beads $f$ in a direction longitudinally of casing $a$ is equal, as will be apparent from a joint consideration of FIGS. 1,2 and 7.

I claim as my invention:

1. An electric fuse for elevated circuit voltages including a. a tubular casing of electric insulating material;

b. a pair of terminal elements arranged at the ends of said casing and closing said casing;

c. a pulverulent arc-quenching filler inside said casing;

d. a fusible element embedded in said filler conductively interconnecting said pair of terminal elements, said fusible element being wound in quarter turn sections of substantially constant pitch around the lateral sides of a space in the form of a four sided prism; and e. a plurality of beads of a gas-evolving material supported by said fusible element, positioned on all four sides of said space and substantially equally distributed among said four sides thereof, said beads being mounted periodically on said quarter turn sections of said fusible element in such a way that bead-bearing quarter turn sections of said fusible element alternate with equal numbers of non-bead-bearing quarter turn sections thereof.

2. An electric fuse as specified in claim 1 wherein the length of each of said plurality of beads is substantially equal to the width of said lateral sides of said space in the form of a four sided prism.

3. An electric fuse for elevated circuit voltage including a. a tubular casing of electric insulating material;

b. a pair of terminal elements arranged at the ends of said casing and closing said casing;

c. a pulverulent arc-quenching filler inside said casing;

d. a fusible element embedded in said filler conductively interconnecting said pair of terminal elements, said fusible element being wound in consecutive quarter turn sections around a space in the form of a four sided prism; and e. a plurality of beads of a gas-evolving material supported by quarter turn sections of said fusible element that are spaced from each other by a fixed number of non-bead-supporting quarter turn sections, said fixed number of non-bead-supporting quarter turns being selected in such a way that the constituent beads of said plurality of beads are substantially equally apportioned to each of the four lateral planes of said space in the form of a four sided prism.

4. An electric fuse as specified in claim 3 wherein the length of each of said plurality of beads is substantially equal to the length of one of said quarter turn sections of said fusible element.

5. An electric fuse for elevated circuit voltages including a. a tubular casing of electric insulating material;

b. a pair of terminal elements arranged at the ends of said casing and closing said casing;

c. a pulverulent arc-quenching filler inside said casing;

d. a fusible element embedded in said filler conductively interconnecting said pair of terminal elements, said fusible element being wound around the lateral sides of a space in the shape of a four sided prism forming bends coextensive with the edges of said space that are unsupported by any supporting means except said filler; and e. a plurality of beads of a gas-evolving material serially mounted on said fusible element, beads being arranged contiguously along said fusible element having substantially equal spacing in a direction longitudinally of said casing and beads being arranged contiguously along said fusible element being further angularly displaced in the same sense of rotation.

6. An electric fuse as specified in claim 5 wherein the length of each of said plurality of beads is substantially equal to the spacing between contiguous edges of said space in the shape of a four sided prism.

7. An electric fuse as specified in claim 6 wherein the length of each of said plurality of beads is in excess of ¾ of the spacing between contiguous edges of said space in the shape of a four sided prism.

* * * * *